US009829265B2

(12) United States Patent
Reed

(10) Patent No.: US 9,829,265 B2
(45) Date of Patent: Nov. 28, 2017

(54) SECURE GUN MOUNT

(71) Applicant: James Casey Reed, Los Ranchos de Albuquerque, NM (US)

(72) Inventor: James Casey Reed, Los Ranchos de Albuquerque, NM (US)

( * ) Notice: Subject to any disclaimer, the term of this patent is extended or adjusted under 35 U.S.C. 154(b) by 0 days.

(21) Appl. No.: 15/180,480

(22) Filed: Jun. 13, 2016

(65) Prior Publication Data

US 2016/0363408 A1 Dec. 15, 2016

Related U.S. Application Data

(60) Provisional application No. 62/174,124, filed on Jun. 11, 2015.

(51) Int. Cl.
*F41C 27/00* (2006.01)
*F41A 23/60* (2006.01)
*F41A 23/16* (2006.01)

(52) U.S. Cl.
CPC ..... *F41A 23/60* (2013.01); *F41A 23/16* (2013.01)

(58) Field of Classification Search
CPC ..... F41A 23/60; F41A 23/16
USPC ..... 42/94; 89/40.06; 73/167; 248/163.1
See application file for complete search history.

(56) References Cited

U.S. PATENT DOCUMENTS 1,457,407 A * 6/1923 Stokes ..... F41A 23/16 89/37.04
2,378,545 A * 6/1945 Fraser ..... F41A 23/16 33/645
2,729,975 A * 1/1956 Hawthorne ..... F41A 23/16 73/11.04
3,041,938 A * 7/1962 Seabrook ..... F41A 23/16 42/94
3,358,504 A * 12/1967 Freebairn ..... F41A 23/16 73/167
3,827,172 A * 8/1974 Howe ..... F41A 23/00 42/94
4,971,208 A * 11/1990 Reinfried, Jr. ..... A47B 81/005 211/64
6,526,687 B1 * 3/2003 Looney ..... F41A 23/16 42/94
6,772,549 B2 * 8/2004 Muhlestein ..... F41A 23/06 224/150

(Continued)

*Primary Examiner* — Samir Abdosh
(74) *Attorney, Agent, or Firm* — Maier & Maier, PLLC

(57) ABSTRACT

A shooting rest may be provided. The shooting rest may reduce the recoil, muzzle rise, and shock wave from firing a rifle or other weapon. A target may remain in the cross hairs while shooting, thus facilitating target memory or easy and fast target re-acquisition. When testing the amount of powder in a casing and weight of bullet in a reloaded round, the shooting rest may help eliminate movement variables so assessment of reloaded ammunition can be more accurately observed. The shooting rest may include a rear support, a front support, a frame, and a lock down bar to secure the front support to a shooting bench or table. The rear support may prevent the muzzle from moving upward and the front support may absorb some of the recoil energy to keep the target in sight. The frame may be secured by the lock down bar and may connect the front support to the table. Safety may be greatly enhanced by having the gun secured to a table during cleaning and maintenance operations.

2 Claims, 9 Drawing Sheets

(56) References Cited

U.S. PATENT DOCUMENTS 6,877,266 B1 * 4/2005 Brownlee ..... F41A 23/16 42/90
7,356,960 B1 * 4/2008 Knitt ..... F41A 23/16 42/94
7,963,206 B2 * 6/2011 Bartle ..... F41A 23/16 42/94
8,276,306 B2 * 10/2012 Lickteig ..... F41A 23/06 211/64
8,307,576 B1 * 11/2012 Bogart ..... F41A 23/16 248/176.1
8,322,068 B2 * 12/2012 Wilson ..... F41A 23/18 42/90
8,931,193 B1 * 1/2015 Bogart ..... F41A 23/16 248/163.1
9,163,893 B1 * 10/2015 Gutierrez ..... F41A 23/02
2002/0040544 A1 * 4/2002 Muhlestein ..... F41A 23/06 42/94
2004/0020097 A1 * 2/2004 Deros ..... F41A 23/02 42/94
2004/0134113 A1 * 7/2004 Deros ..... F41A 23/02 42/94
2007/0068379 A1 * 3/2007 Sween ..... F41A 23/16 89/37.04
2008/0134555 A1 * 6/2008 Werner ..... F41A 23/16 42/69.01
2008/0209790 A1 * 9/2008 Bartle ..... F41G 1/54 42/94
2009/0188146 A1 * 7/2009 Werner ..... F41A 23/16 42/94
2012/0222344 A1 * 9/2012 Werner ..... F41A 29/00 42/94
2014/0237882 A1 * 8/2014 Banes ..... F41A 23/16 42/94

* cited by examiner

SECURE GUN MOUNT

BACKGROUND

Recoil from large caliber firearms may cause significant movement that ay greatly reduce the accuracy of a shot. When the cartridge is fired, momentum in the opposite direction to the momentum of the projectile is applied to the weapon. This momentum may result in significant upward and rear movement of the muzzle, and loss of the targeting corrections previously made by the shooter. To assess the accuracy of a gun or rifle, it is essential to minimize the movement of the firearm due to the recoil. Consequently, a shooter may place the firearm in a shooting rest to stabilize it as much as possible during the discharge. The rests themselves may be placed on a stable bench or table. The shooter then may fire the weapon from the rest. It therefore may be desired to utilize a rest to hold steady a firearm while shooting.

SUMMARY

According to an exemplary embodiment, a firearm shooting rest may be provided. The firearm shooting rest may include an elevation adjustment and support element for supporting the buttstock of a firearm. The elevation adjustment and support element may have an elongated lower vertical section adjustably connected by a vertical adjustment member to an upper vertical section. The upper vertical section is configured to support the firearm buttstock. The firearm shooting rest may further include a front support capable of clamping the forend of a firearm, such that the firearm can rotate. The front support may have a clamp disposed on a vertical member and the vertical member may be rotatably supported by at least one horizontal member. The front support may be secured to a structure, such that horizontal movement is restricted.

According to another exemplary embodiment, a firearm shooting rest may be provided. The firearm shooting rest may include an elevation adjustment and support element for supporting the buttstock of a firearm. The elevation adjustment and support element may have an elongated lower vertical section adjustably connected by a vertical adjustment member to an upper vertical section with a buttstock clamp. The upper vertical section is configured to support the firearm buttstock. The firearm shooting rest may further include a front support capable of clamping the forend of a firearm, such that the firearm can rotate. The front support may have a clamp disposed on a vertical member and the vertical member may be rotatably supported by at least one horizontal member. The shooting rest may have a bar connecting the elevation adjustment and support element and the front support to restrict horizontal separation. The front support may be secured to a structure, such that horizontal movement or recoil is restricted.

BRIEF DESCRIPTION OF THE DRAWINGS

Advantages of embodiments of the present invention will be apparent from the following detailed description of the exemplary embodiments. The following detailed description should be considered in conjunction with the accompanying figures in which.

DETAILED DESCRIPTION

Aspects of the present invention are disclosed in the following description and related figures directed to specific embodiments of the invention. Those skilled in the art will recognize that alternate embodiments may be devised without departing from the spirit or the scope of the claims. Additionally, well-known elements of exemplary embodiments of the invention will not be described in detail or will be omitted so as not to obscure the relevant details of the invention.

As used herein, the word "exemplary" means "serving as an example, instance or illustration." The embodiments described herein are not limiting, but rather are exemplary only, It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

A shooting rest, or secure gun mount, that may eliminate the recoil, muzzle rise, and shock wave from firing a rifle or other weapon may be provided. A target may remain in the cross hairs while shooting, thus facilitating target memory or easy and fast target re-acquisition. When testing the amount of powder in a casing and weight of bullet in a related round, the shooting rest may help eliminate movement variables on assessment of reloaded ammunition can be more accurately observed. The shooting rest may include a rear support, a front support, a frame, and a lock down bar to secure the front support to a shooting bench or table. The rear support may prevent the muzzle from moving upwards and the front support may absorb some of the recoil energy to keep the target in sight. The frame may be secured by the lock down bar and may connect the front support to the table. The shooting rest may minimize the imprecisions caused by the shooter's movement, and may provide a stable, accurate method of steadying a firearm while shooting. Safety may further be greatly enhanced by having the gun secured to a table during cleaning and maintenance operations.

Figure 1:
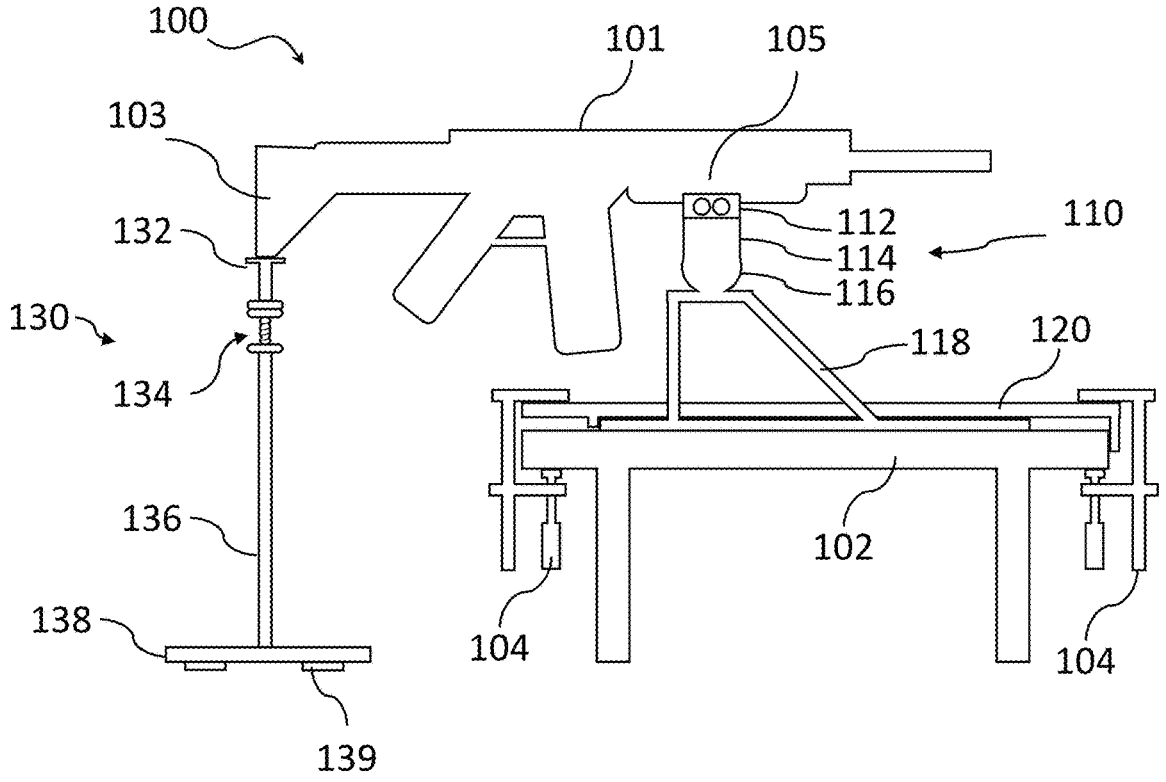
FIG. 1 shows an exemplary embodiment of a shooting rest.

FIG. 1 illustrates an exemplary embodiment of a shooting rest 100 with a firearm 101 placed on top of the rest in the shooting position. Shooting rest 100 may include an elevation adjustment and support element 130, a front support 110, a frame 118 and a lock down bar 120 to re the front support 110 to a shooting bench or table 102. The elevation adjustment and support element 130 may support the stock 103 of the firearm 101 and the front support 110 may support the forend 105 of the firearm 101. The frame 118 be secured by the bar 120 and may connect the front support 110 and a support structure 102. The rear support may be Rubber pads or shock absorbing pads 139 may opt optionally be attached to the plate o cushion the rifle discharge. Pads 139 may alternatively be disposed between plate 138 and lower vertical section 136. The lower vertical section 136 may be connected to an upper vertical section 132 by a vertical adjustment member 134.

Figure 2:
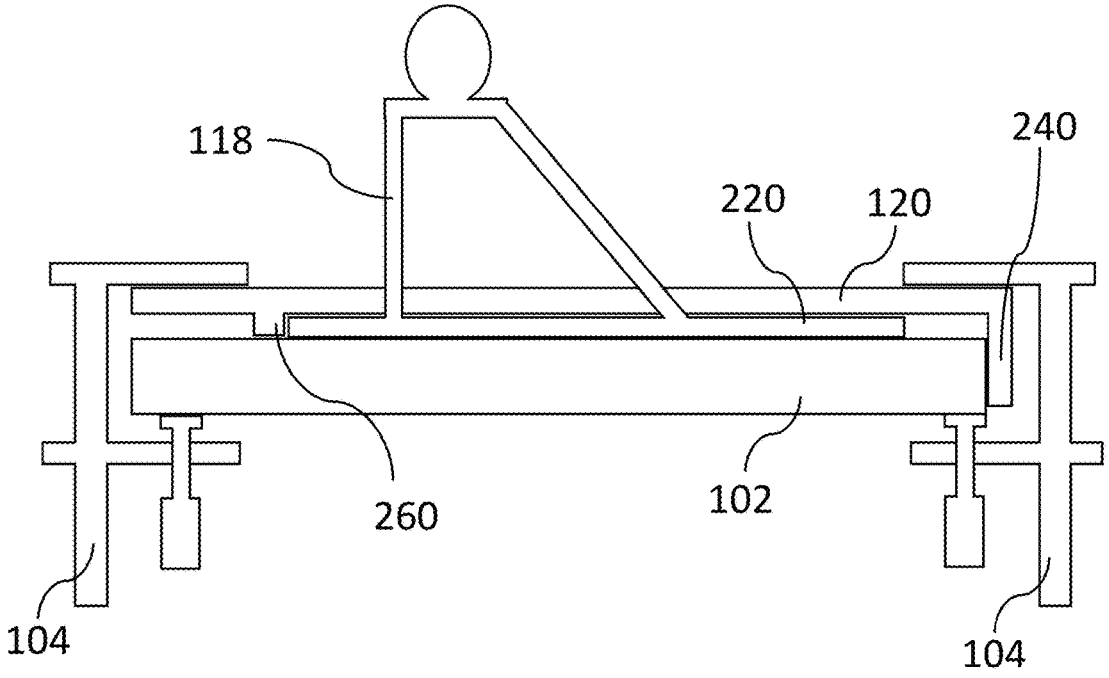
FIG. 2 shows an exemplary embodiment of a lock down bar.

Exemplary FIG. 2 may show a more detailed view of the lock down bar 120 to secure the frame 118 to a support surface, shooting bench or table 102. The horizontal base section 220 of the frame 118 may be situated between the lock down bar 120 and the table 102. The lock down bar 120 may be rigidly connected to the table 102 with one or more clamps 104 and may hold the frame 118 in place. In an exemplary embodiment, the lock down bar 120 may be rigidly connected to a right angle stop plate 240 in the front of the lock down bar 120 to hook the bar to the forward edge of the table 102 so no rearward horizontal movement is possible. In a second exemplary embodiment, lock down bar 120 may include a tab 260 to secure the bottom of the frame 118 against the tab 260 of the lock down bar 120. The stop plate 240 and the tab 260 on the lock down bar 120 may restrict horizontal movement of the frame 118 when the weapon is discharged.

Figure 3:
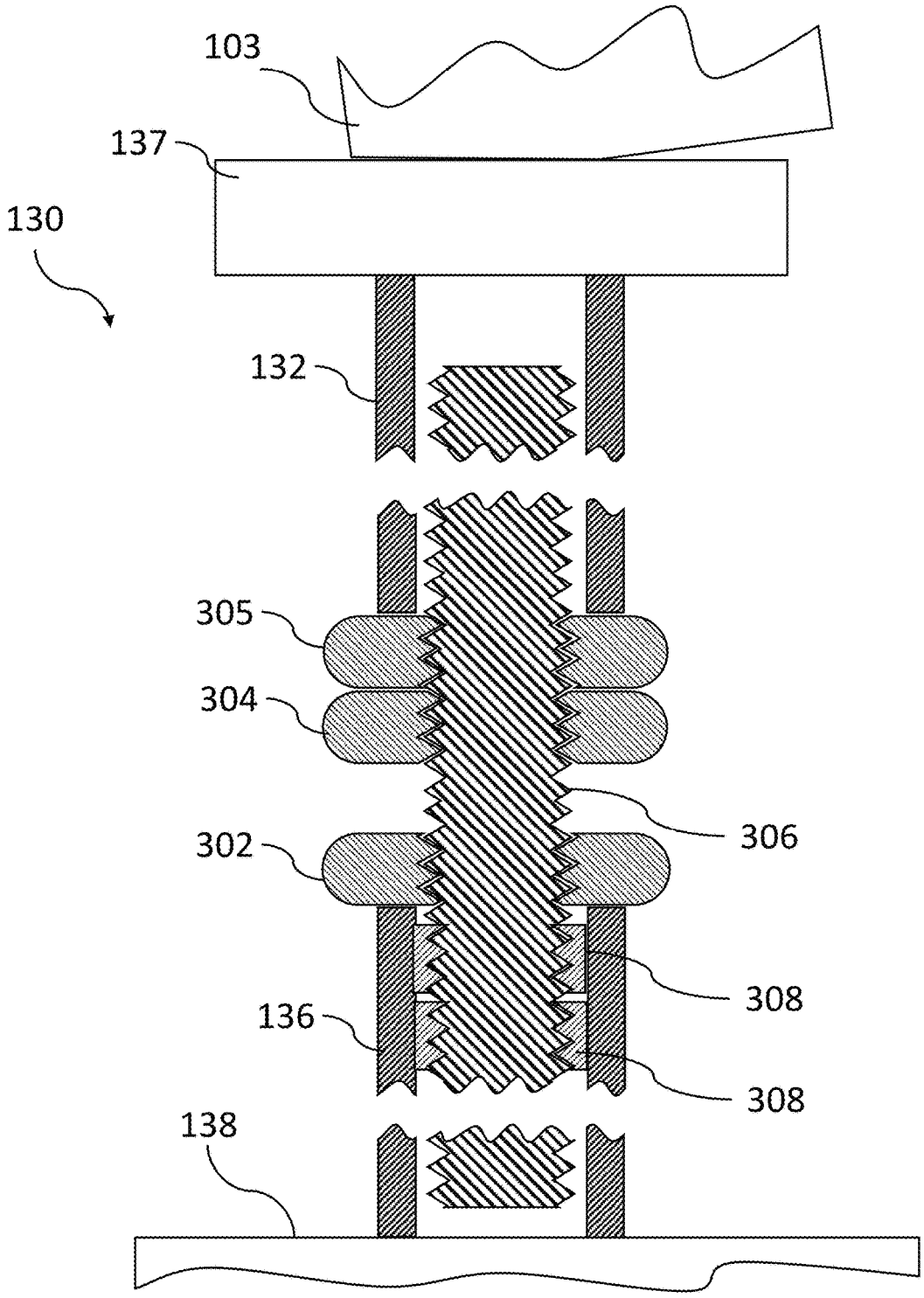
FIG. 3 shows an exemplary embodiment of an elevation adjustment and support system.

Exemplary FIG. 3 may show a more detailed cross-section view of an elevation adjustment and support element 130 for the firearm's stock 103. As shown in FIG. 3, a cylindrical, threaded ram 306 may be removably inserted into an open end of the lower vertical section 136 of the elevation adjustment and support element 130. According to some exemplary embodiments, the length of the threaded ram may be 1 inch less than the length of the lower vertical section 136 and may allow he height of the support system 130 to be approximately doubled to match any height of table or bench used. At least one nut 308 may be rigidly attached to or integrally formed with lower vertical section 136 and threadably engaged with the ram. A threaded adjustment knob or wheel 302 may lock down the cylindrical, threaded ram 306 to the lower vertical section 136. A threaded adjustment knob or wheel 302 may rest on top of the end of the lower vertical section 136 and may be threadably engaged with the ram 306. The ram 306 may be manually translated vertically, in relation to the lower vertical section 136 of the elevation adjustment and support element 130. The threaded ram 306 may be removably inserted into an open end of the upper vertical section 132 of the elevation adjustment and support element 130. The end of the upper vertical section 132 may rest on top of a second threaded adjustment knob or wheel 305 threadably engaged with the ram 306. A third threaded adjustment knob or wheel 304 may be threadably engaged with the ram 306 and may be used to lock the second wheel 305. A mounting bracket 137 may be disposed on the top surface of the upper vertical section 132 of the elevation adjustment and support element 130. In one embodiment, the mounting bracket 137 may be a metal platform designed to receive the end of the firearm's stock. The upper vertical section 132 of the elevation adjustment and support element 130 may move vertically when the adjustment wheel 305 is rotated. The movement of the upper vertical section 132 may allow the vertical position of the rifle stock 103 to be adjusted to a desired position.

Figure 4:
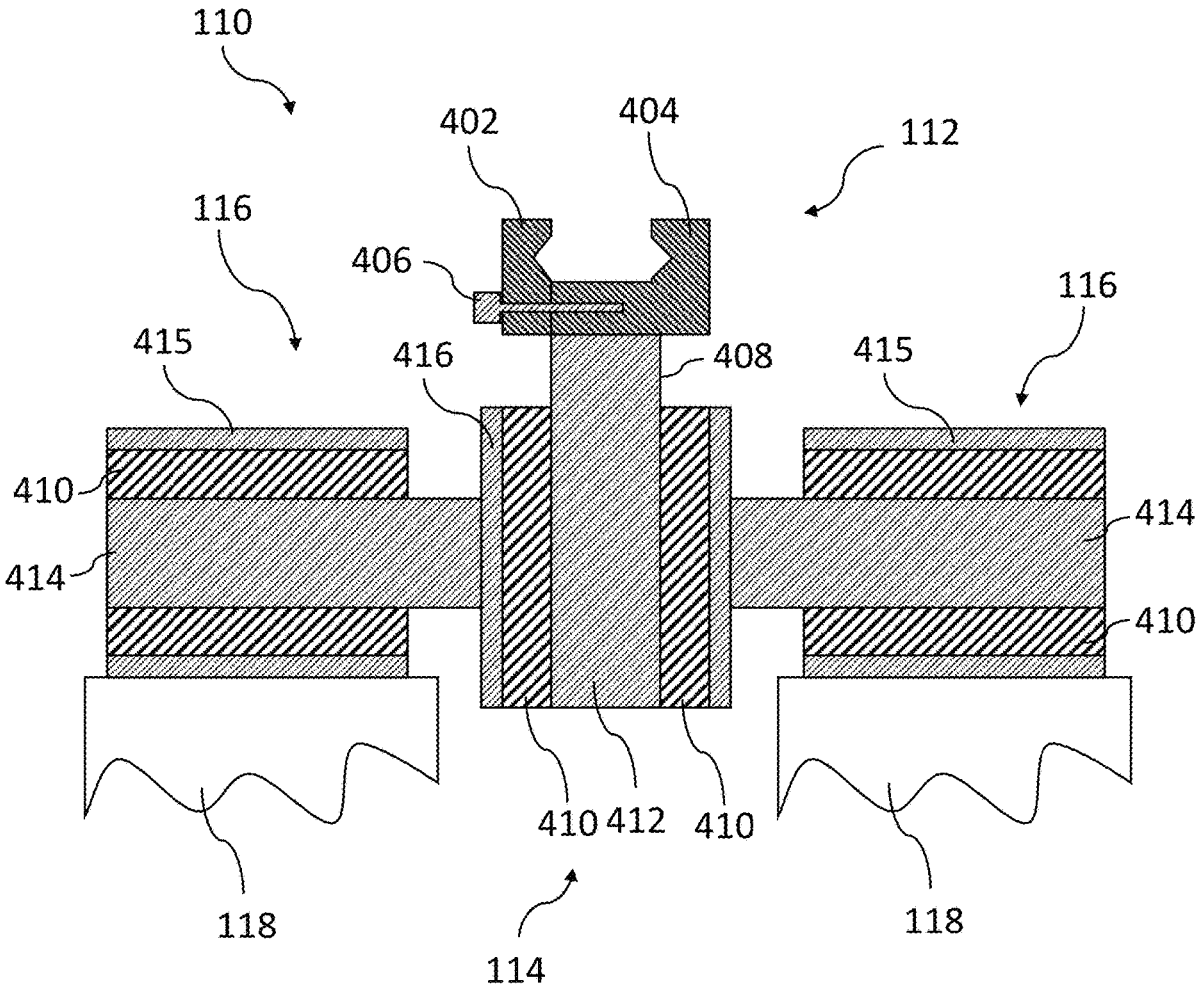
FIG. 4 shows an exemplary embodiment of a front support.

Exemplary FIG. 4 may show a more detailed view of front support 110. The front support 110 may be constructed of a vertical member 114, two horizontal members 116, a rail clamp 112 and frame 118. The two horizontal members 116 may be made of tubes 415 rigidly connected to the frame 118. A shock absorbing material 410 may be placed concentrically in the tubes and rods 414 may be placed at the center of the shock adsorbing material 410, concentrically with the tubes 415. Rods 414, may be capable of rotating within tubes 415, such that the angle of a firearm can be adjusted. The vertical member 114 may be made of a tube 416 rigidly connected to both rods 414 in a perpendicular direction. A shock absorbing material 410 may be placed concentrically in the tubes and a rod 412 may be placed at the center of the shock adsorbing material 410, concentrically with the vertical tube tubes 411. A portion of the rod 412 may protrude from the tube 416 and the shock absorbing material 410 to create an attachment point for the rail clamp 112. The rail clamp 112 may be formed by a fixed arm 404 and a mobile arm 402. The mobile arm 402 may be secured by one or more screws 406. The rail clamp may accommodate Picatinny and Weaver rails.

Figure 5:
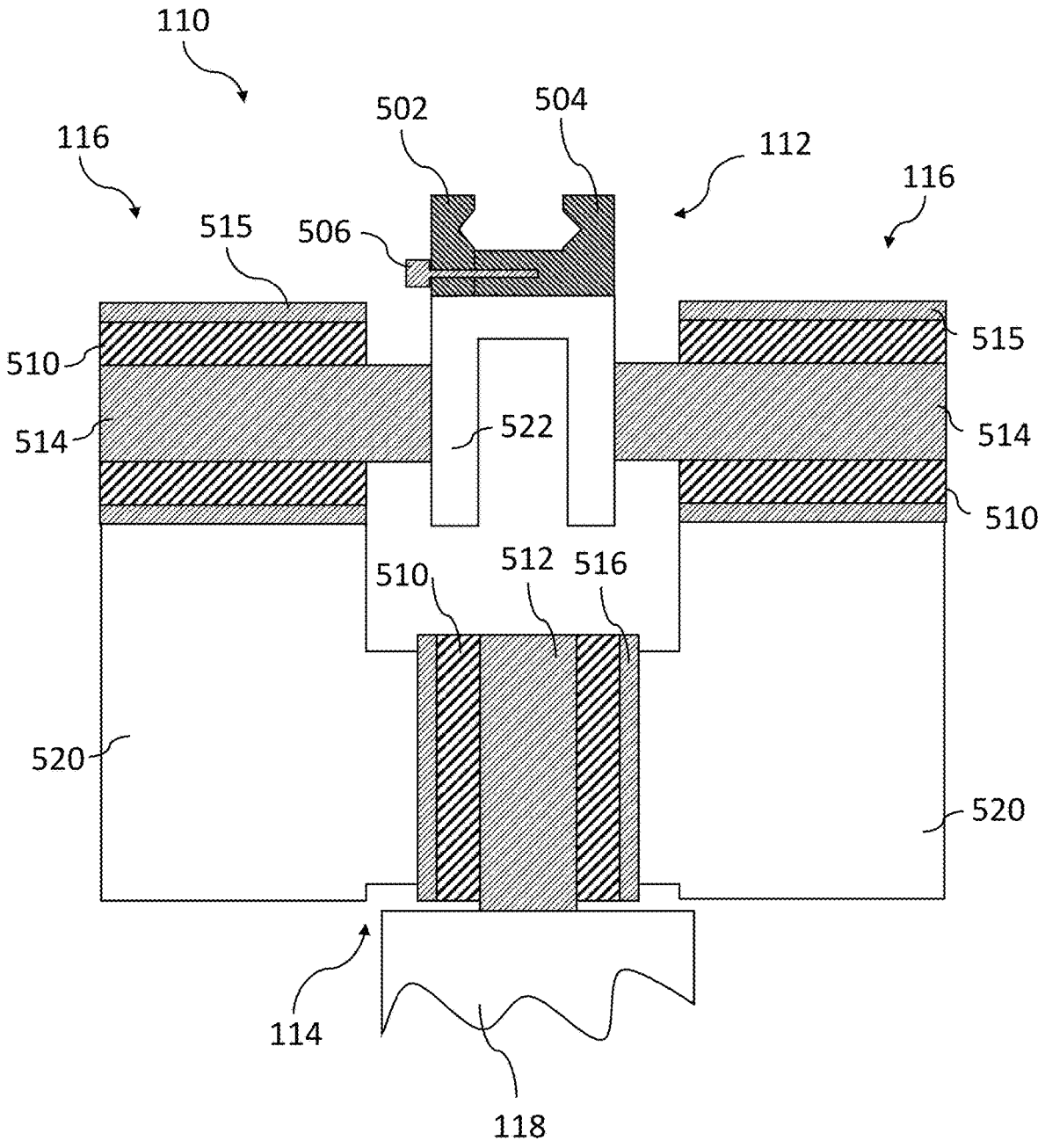
FIG. 5 shows an exemplary embodiment of a front support.

Another exemplary embodiment of a front support 110 may be illustrated in FIG. 5. The front support 110 may be constructed of a vertical member 114, two horizontal members 116, and a rail clamp 112. The vertical member 114 may be made of a tube 516. A portion of the rod 512 may protrude from the tube 516 and the shock absorbing material 510 and may be rigidly connected to the frame 118. Two horizontal members 116 may be constructed of tubes 515 partially filled with a shock absorbing material 510, placed concentrically in the tubes. Rods 514 may be placed at the center of the shock adsorbing material 510, concentrically with the tubes 515. The two horizontal members 116 may be rigidly connected to the vertical member 114 with L-shaped connectors 520. Rods 514 may be rigidly joined by a connector that may create an attachment point for the rail clamp 112. Rods 514 may be capable of rotating within horizontal members 116, such that rail clamp 112 may rotate with a firearm. The rail clamp 112 may be formed by a fixed arm 504 and a mobile arm 502. The mobile arm 502 may be secured by one or more screws 506. The rail clamp may accommodate Picatinny rails, Weaver rails, and other comparable rails as would be understood by a person having ordinary skill in the art. Clamping of the rail may prevent horizontal movement of the firearm 101.

Figure 6:
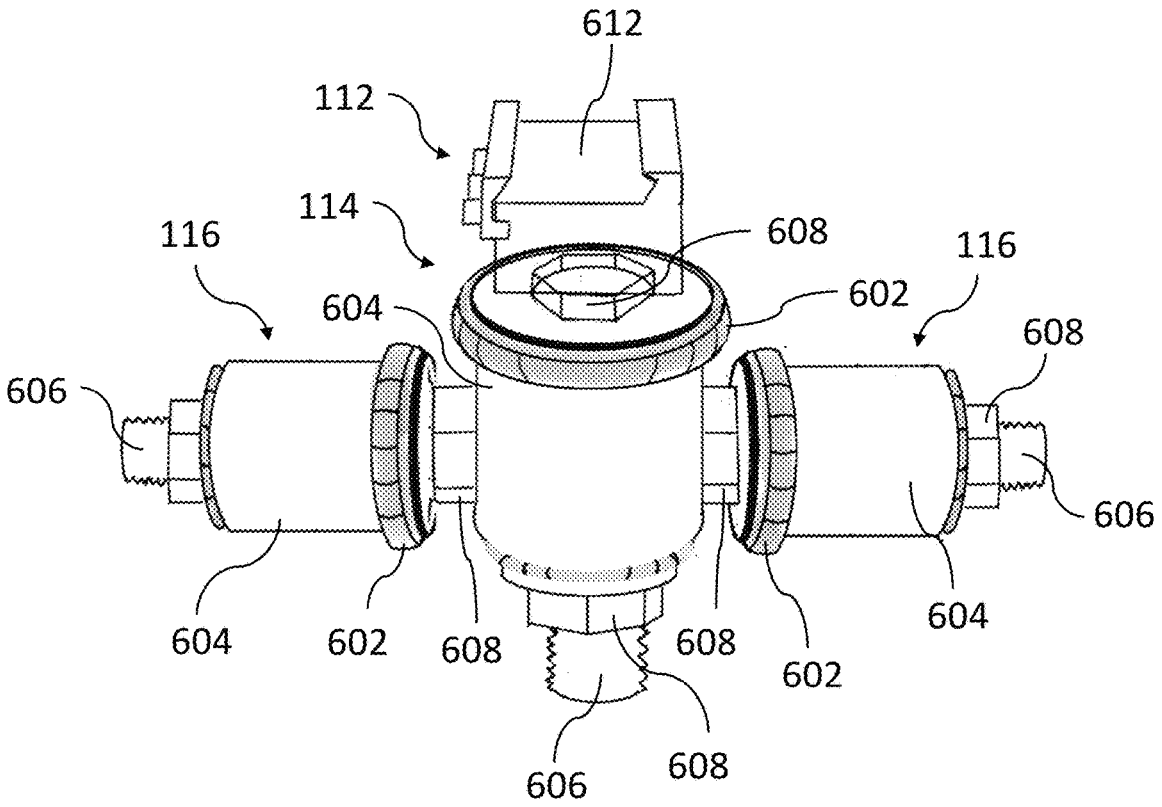
FIG. 6 shows an exemplary embodiment of a front support.
Figure 7A:
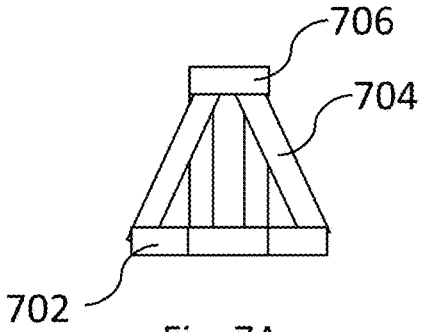
FIG. 7A shows an exemplary embodiment of a frame.
Figure 7D:
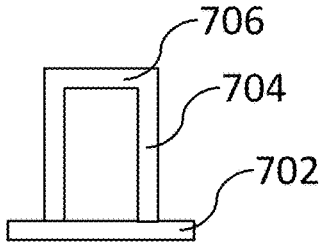
FIG. 7D shows another exemplary embodiment of a frame.
Figure 7E:
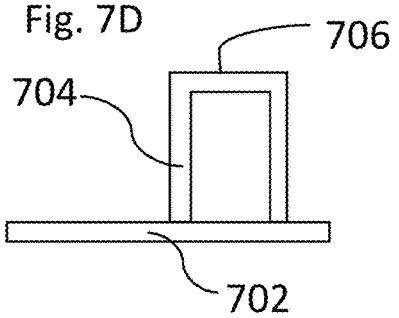
FIG. 7E shows another exemplary embodiment of a frame.
Figure 7B:
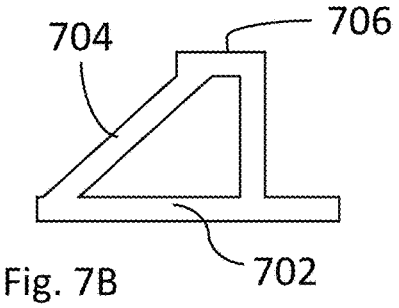
FIG. 7B shows an exemplary embodiment of a frame.
Figure 7C:
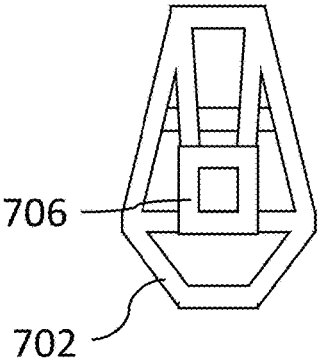
FIG. 7C shows an exemplary embodiment of a frame.
Figure 7F:
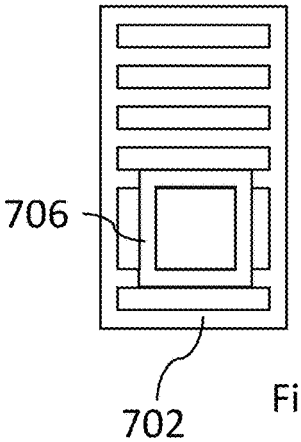
FIG. 7F shows another exemplary embodiment of a frame.

An alternative exemplary embodiment of a front support may be described in FIG. 6. The front support 110 may be constructed of a vertical member 114, two horizontal members 116, a rail clamp 112, and frame 118. The two horizontal members 116 may be made of steel pipe 604 rigidly connected to the frame 118. According to some embodiments, steel pipe 604 may be approximately 1 inch in diameter. Bushings 602 may be placed concentrically in the steel pipe 604 and steel bolts 606 may be placed at the center of the bushings 602, concentrically with the steel pipe 604. Bolts 606 and/or bushings 602 may be capable of rotating within pipes 604. The bushings 602 may optionally be urethane suspension bushings. Steel bolts 606 may optionally be approximately ⅜ inches in diameter. The vertical member 114 may be made of a steel pipe 604 connected to at least one steel bolt 606 in a perpendicular direction. The steel pipe 604 may be approximately 1 inch in diameter and the at least one steel bolt 606 may be approximately ⅜ inches. A bushing 602 may be placed concentrically in steel pipe 604 and a bolt 606 may be placed at the center of the bushings 602, concentrically with the vertical pipe 604. As referenced above, bushing 602 may be a urethane suspension bushing. Each bolt 606 may be secured with a nut 608 coupled with washers 610. Nuts 608 may be ⅜ inch steel nuts and washers 610 may be correspondingly sized. A portion of bolt 606 may protrude from pipe 604 and bushings 602 to create an attachment point for the rail clamp mount 612.

In an exemplary embodiment, still referring to FIG. 6, nut 608, may be tightened up or loosened to impart variable pressure on the bushings 602 and thereby change their shock absorbing properties. Optimum adjustment may be made to adapt to the weight of the weapon and strength of the recoil and immobilize the weapon for cleaning or service adjustments.

FIG. 7A-7F may illustrate two exemplary embodiments of frame 118. Frame 118 may be constructed of a horizontal base section 702, a vertical section 704, and a horizontal support member 706. The frame 118 may provide a rigid infrastructure to the shooting rest by securing the front support to a table or bench 102 (represented in FIG. 1) or other secure support structure, as would be understood by a person having ordinary skill in the art. The elements of the shooting rest 100 may optionally be joined via bolted or welded connections, for example, to form a rigidly constructed unit. In one embodiment, the front support 110 may have a weight from approximately 5 pounds to approximately 20 pounds, an overall length of approximately 20 inches, an overall width of approximately 12 inches, and a height of approximately 11 inches. In some exemplary embodiments, the elevation adjustment and support element 130 may be made of ¾ inch angle iron, may have a weight of approximately 4 pounds and may have a height from approximately 5 inches to approximatively 55 inches. It may further be appreciated that the front support 110 and the elevation adjustment and support system 130 may be made in any desired height and weight.

Figure 8:
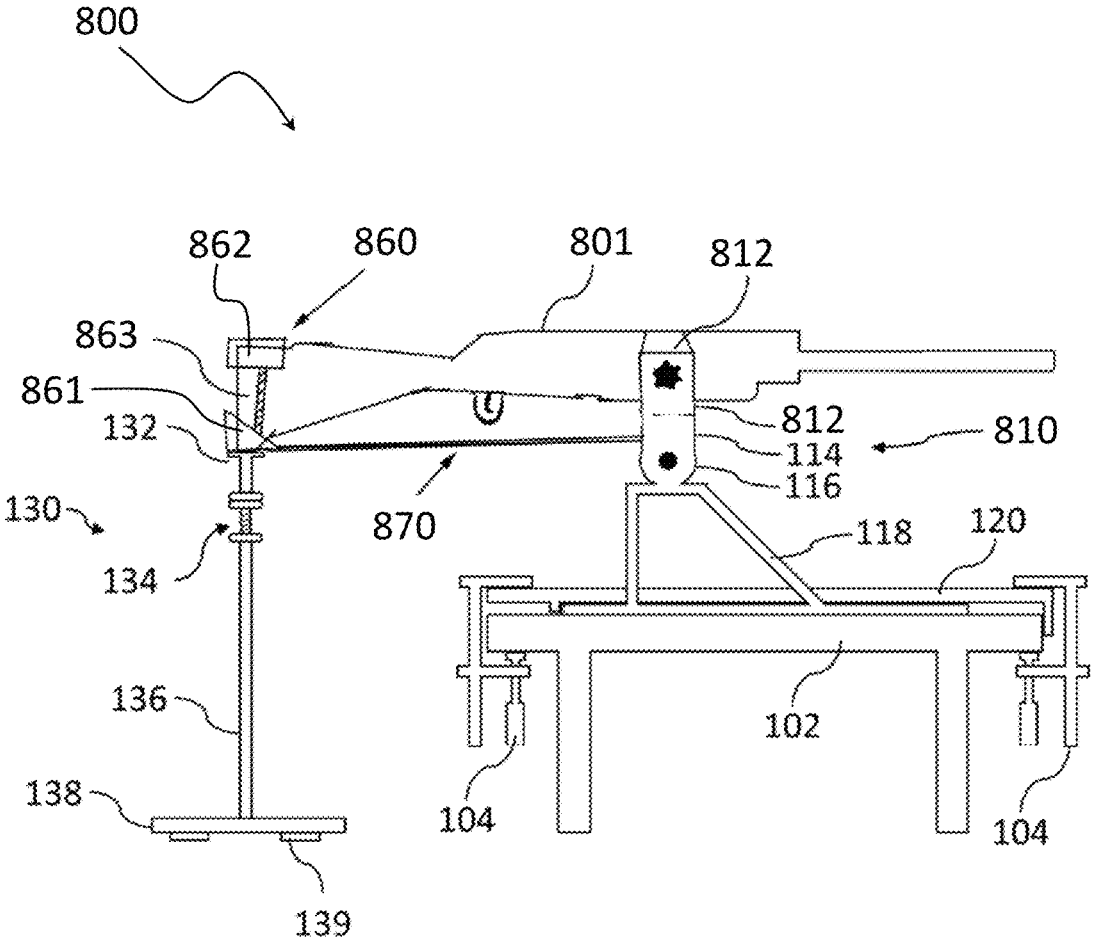
FIG. 8 shows a second exemplary embodiment of a shooting rest.
Figure 9A:
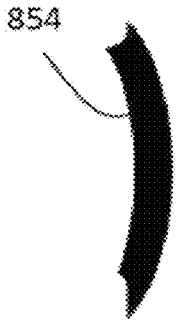
FIG. 9A shows an exemplary embodiment of a forend clamp liner.
Figure 9B:
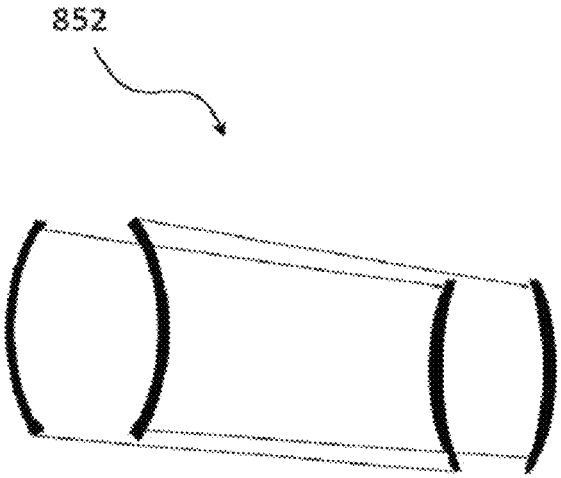
FIG. 9B shows an exemplary embodiment of forend clamp braces.
Figure 10:
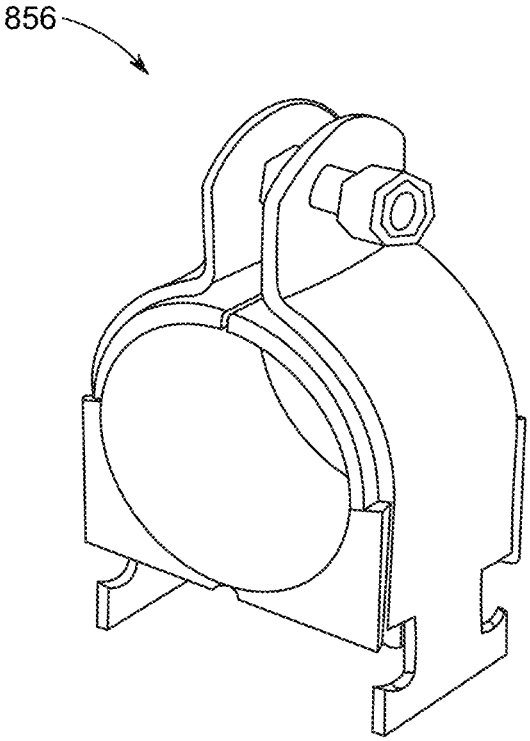
FIG. 10 shows an exemplary embodiment of a forend clamp pipe clamp.

According to another exemplary embodiment, with reference to FIGS. 8-10, a shooting rest 800 may secure a firearm 801, which does not have a rail for secure clamping by the shooting rest 800. Without secure clamping, a firearm may move in a rearward, horizontal direction when fired. Front support 810 of shooting rest 800 may have a forend clamp 812 capable of securely wrapping around the hand guard, forend, or barrel of the firearm. According to some exemplary embodiments, forend clamp 812 may include two curved braces 852 cut to a desired length and lined with a liner 854 for packing around the firearm 801. At least one pipe clamp 856 may pass around braces 852 and liner 854 and be capable of tightening braces 852 and liner 854 around the firearm. Braces 852 may be partial pieces of pipe, such as 2 inch to 3 inch PVC pipe and may be cut to a desired length, such as 5 inches. The pieces may be cut lengthwise to reduce the arc length. Liner 854 may be high density foam. Pipe clamp 856 may have a bolt and anchor tied to the gun mount shock absorbing element of front support 810. The shock absorbing element may include horizontal and vertical members 116, 114. The braces may be bolted to the pipe clamp 856, securing the forward hand guard of the firearm with the gun mount. Forend clamp 812 may be interchangeable with rail clamp 112 on vertical member 114. In some further exemplary embodiments, forend clamp 812 may be clamped onto the hand guard of a firearm 101 with horizontal pressure and a high density rubberized convex pad that is adjustable for various sizes or widths of handguards.

Shooting rest 800 may further include a buttstock clamp 860. Buttstock clamp 860 may secure the buttstock vertically and horizontally. Buttstock clamp 860 may include a bottom buttstock brace 861 and a top buttstock brace 862. The bottom and top buttstock braces 861, 862 may be adjustably connected by at least one buttstock clamp connecting rod 863. In some exemplary embodiments, connecting rod 863 may be threaded or capable of adjusting the braces 861, 862, as would be understood by a person having ordinary skill in the art. When a firearm 801 buttstock is inserted between the bottom and top braces 861 862, the braces may be tightened together, securely clamping the buttstock. A bar 870 may connect the buttstock clamp 860 to the front support 810. Bar 870 may be affixed to front support 810, such that t can rotate with vertical member 114 as the elevation of the buttstock is adjusted, as would be understood by a person having ordinary skill in the art. Bar 870 may restrict the horizontal relationship between the buttstock clamp 860 and forend clamp 812, which may in turn prevent the firearm from traveling in a rearward horizontal direction from firing or recoil.

Components of the shooting res s 100 and 800 described above may be used in any desired combination. The secure bracing of the firearm during operation allows for judging reload cartridge accuracy, scope sighting, target shooting, safe cleaning, safe assembling, and safe disassembling.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A firearm shooting rest comprising:

an elevation adjustment and support element for supporting the buttstock of a firearm, wherein the elevation adjustment and support element has an elongated lower vertical section adjustably connected by a vertical adjustment member to an upper vertical section, and wherein the upper vertical section is configured to support the firearm buttstock; and a front support configured to rotatably clamp the forend of a firearm, wherein the front support comprises a clamp disposed on a vertical member and the vertical member is rotatably supported by at least one horizontal member;

wherein the front support is secured to a structure, such that horizontal movement is restricted wherein the lower vertical section of the elevation adjustment and support element comprises a threaded top opening, the vertical adjustment member comprises a threaded ram configured to insert in the threaded lower vertical section, and the top vertical section comprises a hollow member configured to pass over the vertical adjustment member; and wherein three threaded adjustment knobs are engaged on the vertical adjustment member, such that a first threaded adjustment knob is configured to tighten down on the threaded top opening of the lower vertical section, a second threaded adjustment knob is configured to support a bottom end of the top vertical section, and a third threaded adjustment knob is configured to tighten against the second threaded adjustment knob to secure its vertical position.

2. The firearm shooting rest of claim 1, wherein the elevation adjustment and support element further comprises a base having at least one shock absorbing pad.

* * * * *